US007188492B2

(12) United States Patent
Corduan et al.

(10) Patent No.: US 7,188,492 B2
(45) Date of Patent: Mar. 13, 2007

(54) PLATE HEAT EXCHANGER

(75) Inventors: Horst Corduan, Puchheim (DE); Dietrich Rottmann, Munich (DE)

(73) Assignee: Linde Aktiengesellschaft, Wiesbaden (DE)

( * ) Notice: Subject to any disclaimer, the term of this patent is extended or adjusted under 35 U.S.C. 154(b) by 0 days.

(21) Appl. No.: 10/612,287

(22) Filed: Jul. 3, 2003

(65) Prior Publication Data

US 2004/0069471 A1 Apr. 15, 2004

Related U.S. Application Data

(63) Continuation-in-part of application No. 10/347,486, filed on Jan. 21, 2003, now abandoned.

(30) Foreign Application Priority Data

Jan. 18, 2002 (DE) ..... 102 01 832

(51) Int. Cl.
*F25J 3/00* (2006.01)
*F28D 7/10* (2006.01)
*F28F 3/00* (2006.01)

(52) U.S. Cl. ..... 62/640; 62/903; 165/140; 165/166

(58) Field of Classification Search ..... 62/640, 62/643, 903, 641; 165/140, 166, 165, 164, 165/167
See application file for complete search history.

(56) References Cited

U.S. PATENT DOCUMENTS 3,282,334 A 11/1966 Stahlheber
3,759,322 A 9/1973 Nasser et al.
4,128,410 A 12/1978 Bacon
4,721,164 A * 1/1988 Woodward ..... 166/372
5,031,693 A * 7/1991 VanDyke ..... 165/166
5,205,351 A 4/1993 Muller et al.
5,324,452 A * 6/1994 Allam et al. ..... 252/373
5,333,683 A * 8/1994 Arriulou et al. ..... 165/166
5,462,113 A * 10/1995 Wand ..... 165/167
5,755,280 A * 5/1998 da Costa et al. ..... 165/166
5,979,182 A * 11/1999 Goto et al. ..... 62/643
6,089,313 A * 7/2000 Levy et al. ..... 165/140
6,128,920 A * 10/2000 Matsuo et al. ..... 62/627
6,142,221 A * 11/2000 Johansson ..... 165/140
6,347,662 B1 * 2/2002 Davidian et al. ..... 165/166
6,516,874 B2 * 2/2003 Mathur et al. ..... 165/166
6,629,433 B2 * 10/2003 Corduan et al. ..... 62/617

OTHER PUBLICATIONS

European International Search Report issued Jan. 14, 2003 in EP 02 00 9896.

* cited by examiner

*Primary Examiner*—William C. Doerrler
(74) *Attorney, Agent, or Firm*—Millen, White, Zelano, Branigan, P.C.

(57) ABSTRACT

A plate heat exchanger for indirect heat exchange of several fluid flows (30, 40, 50) with a heat transfer medium/cooling medium (10, 20) in a heat exchanger core (9) has a plurality of heat exchange passages within the core for the heat transfer medium/cooling medium (10, 20), a first fluid flow (30, 40, 50) and a second fluid flow (30, 40, 50). All heat exchange passages for the first fluid flow (40) are located In a first component area, and all heat exchange passages for the second fluid flow (30) are located in a second component area. The first and the second component areas do not intersect and each extend over the entire height of the heat exchanger core (9). The heat exchanger is particularly suitable for use in air-separation processes.

22 Claims, 10 Drawing Sheets

PLATE HEAT EXCHANGER

This application is a continuation-in-part of U.S. patent application Ser. No. 10/347,486, filed Jan 21, 2003 now abandoned.

The invention relates to a plate heat exchanger for indirect heat exchange of several fluid flows with a heat transfer medium/cooling medium in a heat exchanger core that has a plurality of heat exchange passages for the heat transfer medium/cooling medium, a first fluid flow and a second fluid flow. The invention furthermore relates to a process for indirect heat exchange of several fluid flows with a heat transfer medium/cooling medium in a heat exchanger core, the heat transfer medium/cooling medium, a first fluid flow and a second fluid flow being routed through a plurality of heat exchange passages.

In low-temperature separation of air, the feed air that is to be separated must be cooled to the process temperature. This conventionally takes place in the main heat exchanger by indirect heat exchange of the feed air with gas flows that have been obtained from the separation process. The main heat exchanger is generally made as a plate heat exchanger that has a plurality of heat exchange passages for the flows to be treated.

If, for example, two feed air flows of different pressure are supplied to the air-separation system, and oxygen, pure nitrogen and impure nitrogen are obtained as the gaseous products, five flows must be routed through the heat exchanger core. The heat exchanger core must therefore have ten connecting branches for these flows, five for gas inlets and five for gas outlets. The gas flows are then distributed by the respective inlet branch among the assigned heat exchange passages or the gas flows emerging from the heat exchange passages are combined into the corresponding exit branches.

This distribution and collection of gas was performed in the past by distribution zones and collection zones that were integrated into the heat exchanger core. In these distribution and collection zones, at least some of the plates that delineate the individual heat exchange passages from one another are inclined so that the gas that flows in via the inlet branch is routed into the heat exchange passages and the gas flow emerging from the heat exchange passages is deflected to the outlet branch.

The flow conditions are greatly changed in the distribution zones. On the one hand, due to the inclined alignment of the plates, a change of flow direction occurs. On the other hand, the cross-sections of the heat exchange passages in the distribution area are greatly reduced, by which speed changes of the gas that is flowing through are created. Both effects produce an undesirable pressure drop within the heat exchanger core.

DE 10021081 therefore proposes using split heat exchanger cores that are divided by products in large air-separation systems so that only one fluid flow at a time is routed through each heat exchanger core. The fluid flows can be routed directly by the connecting branches into the respective heat exchange passages in one such version without the indicated distribution zones.

This principle can, however, only be used in large air-separation systems in which several heat exchanger cores are needed anyway. For smaller air-separation systems that have only one or two heat exchanger cores, the use of these split heat exchanger cores is not efficient.

SUMMARY OF THE INVENTION

An object of this invention is therefore to develop a process and a device for indirect heating or cooling of several gas flows in which the pressure loss in the heat exchanger is as low as possible.

Upon further study of the specification and appended claims, further objects and advantages of this invention will become apparent to those skilled in the art.

These objects are achieved according to the invention by a plate heat exchanger of the initially mentioned type, the heat exchanger core having a first component area in which all heat exchange passages for the first fluid flow are located, and a second component area in which all heat exchange passages for the second fluid flow are located, the first and the second component areas do not intersect and the first and the second component areas each extend over the entire height of the heat exchanger core, the height of the heat exchanger core being its extension in the direction of the main flow through the heat exchange passages.

The process according to the invention for indirect heat exchange of several fluid flows with a heat transfer medium/cooling medium in a heat exchanger core, the heat transfer medium/cooling medium, a first fluid flow, and a second fluid flow being routed through a plurality of heat exchange passages, is characterized in that the first fluid flow is routed only through a first component area of the heat exchanger core and the second fluid flow is routed only through a second component area of the heat exchanger core, the first and the second component areas do not intersect and the first and the second component areas each extend over the entire height of the heat exchanger core, the height of the heat exchanger core being its extension in the direction of the main flow through the heat exchange passages.

The depth, height and width of the heat exchanger core are defined as follows: A heat exchanger core has a plurality of separating plates that are arranged parallel to one another. The extension of the heat exchanger core in one direction perpendicular to the separating plates is referred to as the depth of the heat exchange core. Between the separating plates there are conventionally so-called fins which divide the spaces between each pair of adjacent separating plates into a group of heat exchange passages that all have the same direction at least over most of the heat exchanger core. The extension of the heat exchanger core in the flow direction through the heat exchange passages is referred to as the height of the heat exchanger. This direction is hereinafter called the vertical for the sake of simplicity. Consequently, the width is defined as the extension of the heat exchanger core in the remaining three-dimensional direction, i.e., the direction in the plane of the separating plates and perpendicular to the main flow direction in the heat exchange passages.

The division into individual areas according to the invention makes it possible to abandon some of the distribution zones. Certain fluid flow passages end in a defined area of the end faces of the heat exchanger core, i.e., the surfaces of the core that are characterized by the width and the depth, in which no other fluid flow passages end. The connecting branch for this fluid flow must therefore be connected to the corresponding area of the end face.

In prior art plate heat exchangers, heat exchange passages for each fluid extend over the entire width of the heat exchanger core. In the direction of the depth the heat exchange passages for the different fluids and for the heat transfer medium are arranged alternately. In order to route each fluid from its fluid supply tube to all respective heat exchange passages the fluid has to be redirected from the area where the fluid supply is connected to the heat exchanger core to the entire cross section of the heat exchanger core. This function is carried out in the distributing zones and collecting zones.

Contrary to that prior art arrangement, in accordance with the invention heat exchange passages for a specific fluid need not be distributed over the entire cross section of the heat exchange core, but can extend only over a portion of the width of the heat exchanger core. As a result, headers can be affixed to the faces of the heat exchanger core which cover the entire area where the respective heat exchange passages end. There is no need to redirect the fluid flows from the heat exchange passages to the respective headers. Distribution of the fluid flow over the entire cross-sectional surface of the heat exchanger core is no longer necessary. Thus, the above-mentioned distributing and collecting zones can be eliminated.

An integrated heat exchanger core is advantageously used, by which at least two fluid flows, preferably all fluid flows, are routed in indirect heat exchange with one or more heating/cooling media. At least some of the groups of heat exchange passages for the fluid flows are divided here into at least two areas in the direction of width. Preferably, all the groups of heat exchange passages provided for the fluid flows are divided accordingly. It is also quite possible and efficient, however, to undertake this division of the group of heat exchange passages for only some of the fluid flows.

Subdivision proceeds such that the space between two adjacent separating plates in which a group of individual heat exchange passages for the fluid flows formed by the fins is subdivided by one or more vertical bulkheads into two or more areas between which no fluid exchange is possible. Within each area there is a plurality of heat exchange passages that are conventionally separated from one another by the vertically running fins. The fins are used essentially for guiding the fluids, but, in contrast to the bulkheads that separate the different areas, they are not essential for isolation of one heat exchange passage from an adjacent heat exchange passage.

The division into individual areas can likewise take place favorably such that the areas occupy only one part of the depth of the heat exchanger core. Thus, it is possible, for example, to subdivide the heat exchanger core into two or more strips that extend over the entire height of the heat exchanger core and that each occupy only part of the depth and only part of the width of the core. With several flows, it is also a good idea to subdivide the heat exchanger core in width and depth and to provide, for example, four areas, of which each is located in one corner of the heat exchanger core.

In the component areas according to the invention, the heat exchange passages that are intended for the respective fluid flow run vertically from one face of the core to the opposing face and run essentially parallel to one another. On each of the two faces where the heat exchange passages end, each of the component areas has one collector/distributor, mounted on the heat exchanger core, which collects or distributes fluid for the corresponding component area. Each collector/distributor thus only has one connecting branch for the supplying or removing fluid. Fluid thus flows from the distributor into the heat exchange passages and from the heat exchange passages into the collector, without a narrowing of the cross section during supplying or discharging. Also, fluid flow is deflected slowly in the collector/distributor. The pressure loss in the heat exchanger core and the pertinent collectors/distributors is thereby minimized.

According to the invention, at least one fluid flow that is desirably subjected to a pressure loss that is as small as possible is routed through one such component area of the heat exchanger core according to the invention. In particular, it is adv antageous to rout through such component areas fluid flows that have a pressure of less than 3.5 bar, and especially a pressure of 1.1–1.8 bar. Of course, one or more heating/cooling media with which the fluid flow undergoes heat transfer also flow through one of the component areas of the heat exchanger core according to the invention.

The invention allows pressure drops in the heat exchanger cores, measured from the inlet branch to the outlet branch, of roughly less than 70 mbar. Conversely, in conventional heat exchangers, wherein the distribution and collection of gas flows between the inlet and the outlet branches and the heat exchange passages is performed by one distribution zone and one collection zone that are integrated into the heat exchanger core with inclined plates, a pressure drop of roughly up to 100 mbar occurs for gas flows with a pressure of 1.2–1.8 bar removed from the low-pressure column. Thus, on the unpressurized side, the invention reduces the pressure drop by roughly 30 mbar. This means that low-pressure flows can be obtained with a pressure that is lower by 30 mbar than otherwise obtained by processes using conventional plate heat exchangers. To maintain the heat exchange conditions of the main condenser, it is then sufficient for the air following the air compressor to be compressed to a pressure that is roughly 90 mbar lower.

The invention is especially well suited for use in processes in which gas flows that have a pressure of less than 3.5 bar, preferably 1.1–1.8 bar, hereinafter called low-pressure flows, are to be brought into indirect heat exchange with a heat transfer medium or cooling medium. According to the invention, only one of these low-pressure gas flows at a time is routed through one component area of the heat exchanger core, i.e., each of the gas flows that have a pressure of less than 3.5 bar has its own component area of the heat exchanger core.

In gas flows with a pressure of more than roughly 4 bar, the pressure loss in the heat exchanger core plays only a subordinate role or can be ignored. It is therefore often advantageous to route one such flow with increased pressure in addition through at least one of the component areas of the heat exchanger core through which one of the low-pressure gas flows is routed.

A heat exchange medium having increased pressure is routed through passages which normally extend over the entire width of the heat exchanger core and which in the direction of the depth are alternately arranged with the heat exchange passages for the low pressure fluid. Pressurized products flows (for example, high pressure nitrogen flow 60) need not necessarily be routed through a separate part of the heat exchanger core as it is the case for the low pressure flows 30, 40, 50. Thus, the heat exchange passages for high pressure flow 60 might be distributed over the entire cross section of a heat exchanger core analogous to the heat exchange passages for the feed air. The high pressure flow 60 would then be routed through one of the component areas in addition to the low pressure gas flowing in that component area.

The process according to the invention is used preferably in low-temperature separation of feed air. In such processes gas flows that have been withdrawn as product from the low-pressure column of a double-column rectifier typically have a pressure only about 0.1 to 0.8 bar over atmospheric pressure so that a reduction of the pressure drop is of great importance. This applies analogously to the gaseous argon product, since the raw argon column is likewise operated under a relatively low pressure.

Gas flows are brought especially advantageously into indirect heat exchange with the feed air. The feed air can be routed here through the heat exchanger core in several flows that are each at a different pressure level. Thus, for example, one flow of the feed air can, on the one hand, be routed through the heat exchanger core at the pressure of the high-pressure column and then fed into the pressure column; on the other hand, another flow of the feed air, upstream from the heat exchanger core, can be further compressed, cooled in the heat exchanger, and then expanded to actively produce cold before being introduced into the rectification system.

In countries with relatively low energy costs, a reduction of pressure drops does not yield any advantage since the costs that are associated with saving energy are high. Therefore, in these applications, it is a better idea not to minimize pressure losses, but rather to increase flow speeds in order to achieve higher pressure drops, by which ultimately a smaller heat exchanger core is sufficient.

Preferably, the fluid flow is routed through the heat exchanger core such that it suffers a pressure drop of 120 to 300 mbar, preferably 120 to 200 mbar. Increasing the pressure drop yields a greater flow speed than in conventional heat exchangers, by which heat transfer coefficients are improved; this ultimately leads to the core volume of the heat exchanger being optionally reduced. For the same pressure drop in the heat exchanger core, the process according to the invention compared to known processes enables a reduction of the core volumes by roughly 15%, from which a considerable cost savings results.

BRIEF DESCRIPTION OF THE DRAWINGS

Various other features and attendant advantages of the present invention will be more fully appreciated as the same becomes better understood when considered in conjunction with the accompanying drawings, in which like reference characters designate the same or similar parts throughout the several views, and wherein:

FIG. 1 shows the process diagram of a low-temperature air-separation system known from the prior art. Compressed and purified feed air 10 is supplied in part directly to a main heat exchanger 1. Another flow of compressed and purified air 20 is further compressed in compressor 4, cooled in an aftercooler 5, and then routed into the main heat exchanger 1. This pressurized air, hereinafter called the turbine air flow 20, is removed from the main heat exchanger 1 at an intermediate location, expaned in the air booster turbine 6, and fed into the low-pressure column 3 of a rectification unit that comprises a high-pressure column 2 and a low-pressure column 3.

Figure 1:
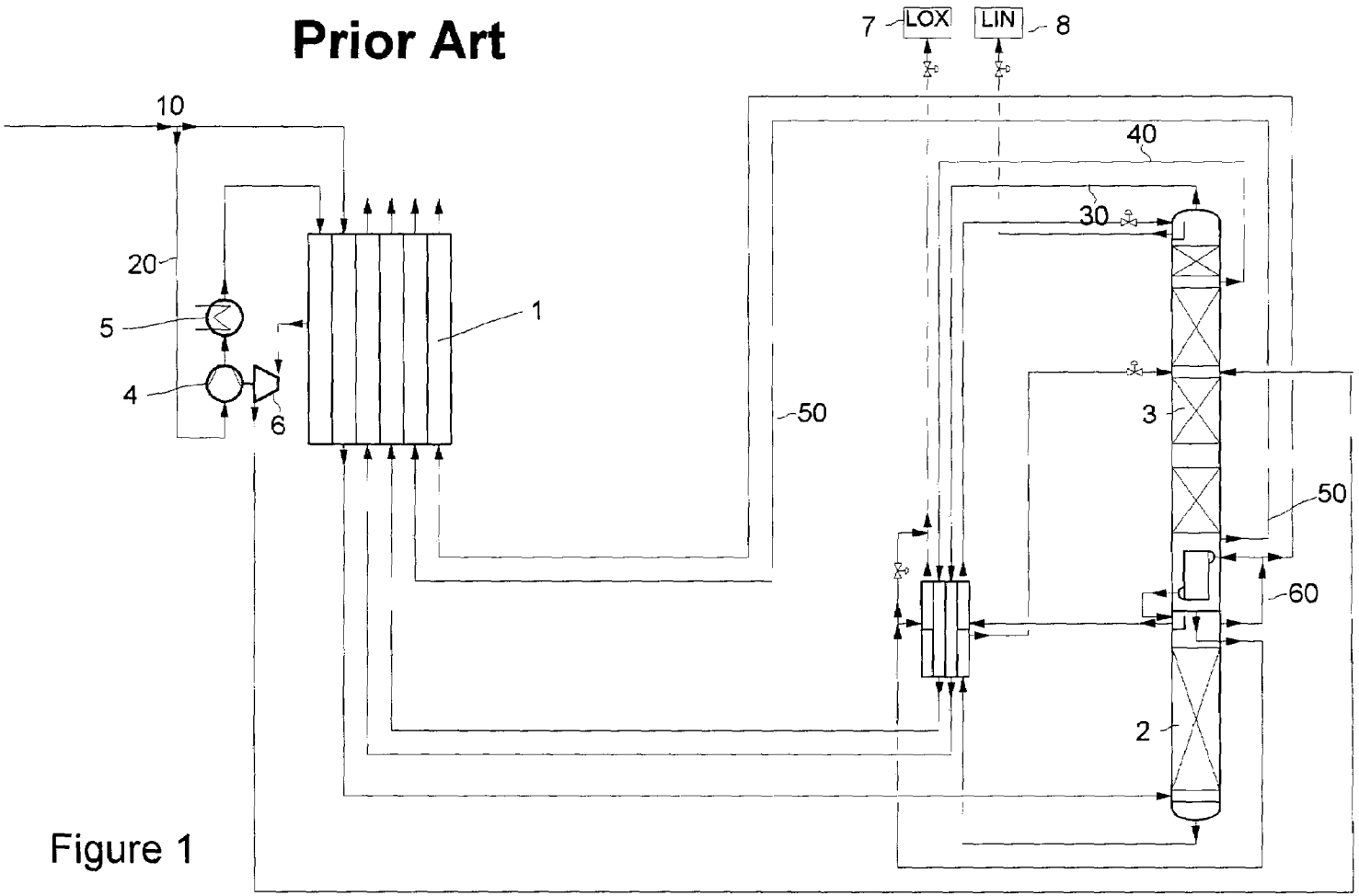
FIG. 1 is a process diagram of a low-temperature air-separation system.

The feed air 10 that has been cooled in the main heat exchanger 1 is supplied to the high-pressure column 2 of the rectification unit. Gaseous oxygen 50, gaseous nitrogen 30 and gaseous impure nitrogen 40 are removed as the regeneration gas with a pressure of roughly 1.3 bar from the low-pressure column 3. At the top of the high-pressure column 2, pressurized nitrogen 60 is withdrawn. Furthermore, it is possible to obtain oxygen and nitrogen as liquid products 7, 8 from the rectification unit. The gas flows 30, 40, 50, 60 are routed into the main heat exchanger 1 and are heated by indirect heat exchange against the feed air flow 10 and the turbine air flow 20.

Figure 4:
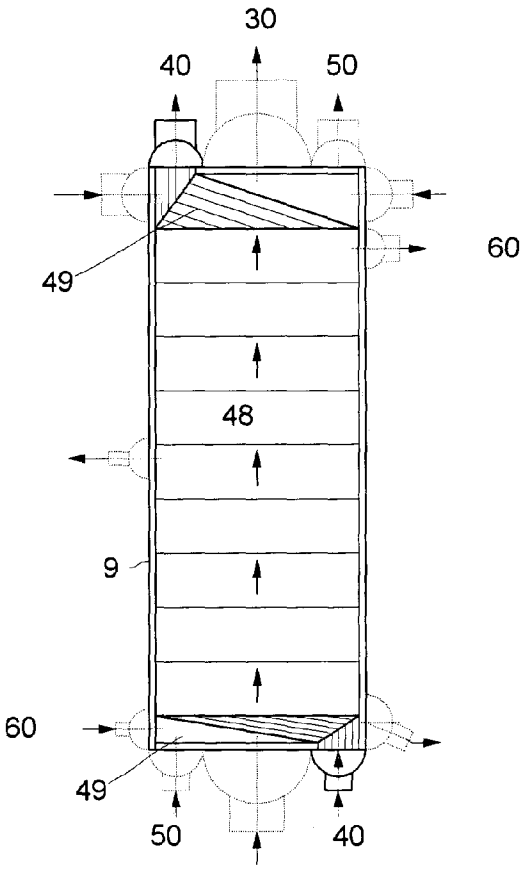
Figure 4 Prior Art
FIGS. 2 to 4 show the arrangement of the distribution passages in conventional plate heat exchangers.
Figure 3:
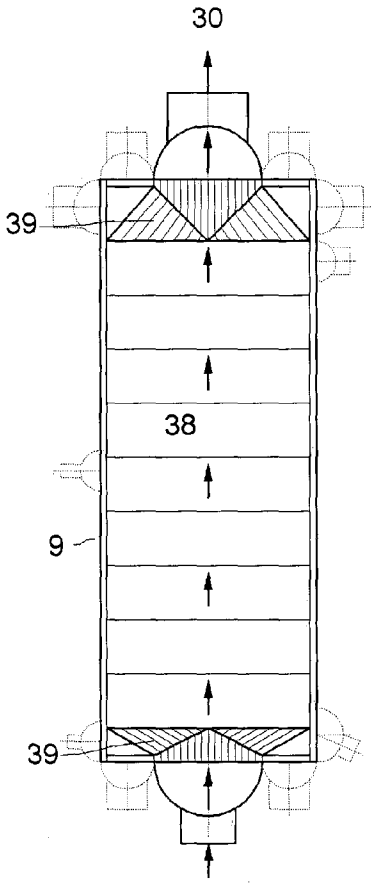
Figure 2:
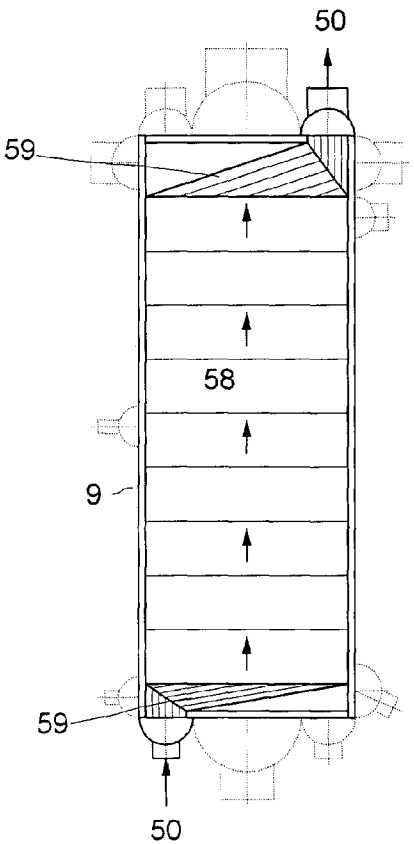

FIGS. 2 to 4 show the structure of a conventional heat exchanger core 9. FIG. 2 shows the plate arrangement in the distribution/collection zones 59 for the oxygen passages 58. FIG. 3 shows the plate arrangement in the distribution/collection zones 39 for the pure nitrogen passages 38, and FIG. 4 accordingly shows the plate arrangement in the distribution/collection zones 49 for the impure nitrogen passages 48.

In the process according to FIG. 1, in the heat exchanger core 9, the fluid flows 30, 40, 50 are routed against the air flow 10 and the turbine air flow 20. The distribution of the respective gaseous product among the corresponding heat exchange passages 38, 48, 58 takes place in the conventional manner via distribution and collection zones 39, 49, 59 that have inclined plates in order to distribute the gas 30, 40, 50 from the supply lines among the passages 38, 48, 58 or to combine the gas emerging from the passages 38, 48, 58 into the corresponding exhaust line.

The distribution/collection zones 39, 49, 59 lead both to changes in flow direction and also to changes in cross-section, which in turn cause changes in the flow velocity. Both have an adverse effect on the flow through the core and produce an undesirable pressure drop over the heat exchanger core 9. The pressure drop has an especially adverse effect for gas flows that have a relatively low pressure of between 1.1 and 1.8 bar.

Figure 5:
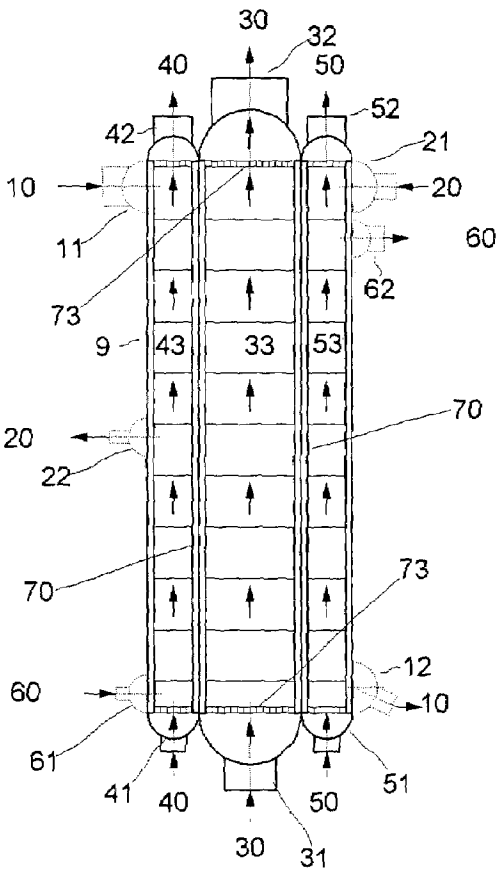
FIG. 5 shows the arrangement of the heat exchange passages for a plate heat exchanger according to the invention.

FIG. 5 shows the structure of the main heat exchanger 1 according to the invention. In this case, all flows 10, 20, 30, 40, 50, 60 are routed through a common heat exchanger core 9, i.e., the main heat exchanger 1 is made as an integrated heat exchanger. The heat exchanger core 9 is composed of a plurality of separating plates that are parallel to the plane of the drawings (see reference numeral 111 in FIG. 14) and between which a plurality of heat exchange passages are located.

Below, the extension of the heat exchanger core 9 perpendicular to the plane of the drawings is called its depth, its extension in the direction of the heat exchange passages that is labelled by arrows in FIGS. 2 to 4 is called its height, and its extension in the plane of the drawings perpendicular to the flow direction through the heat exchange passages is called its width.

The feed air 10, the high-pressure air (turbine air flow) 20, and the gaseous pressurized nitrogen 60 taken from the pressure column 2 are routed via the collectors/distributors 11, 21, 61 into the heat exchanger core 9. In the heat exchanger core 9, these flows 10, 20, 60 are distributed in the conventional manner in a distribution/collection zone, which is not shown in the drawings and which has inclined plates, over the entire width of the heat exchanger core 9, are further routed through vertically running heat exchange passages, and are supplied to the respective collectors 12, 22, 62 via another distribution/collection zone with inclined plates.

In the distribution/collection zones, the flows 10, 20, 60 undergo pressure losses that are caused by the changes in flow direction and changes in the cross-sections of the individual passages. These pressure losses of roughly up to 100 mbar are, however, not relevant for the feed air 10, the high-pressure air 20, and the pressurized nitrogen product 60, since these flows have a much higher absolute pressure of more than 5 bar. Conversely, for low-pressure flows 30, 40, 50, which have pressures that are only slightly above atmospheric pressure, such pressure losses have great importance.

According to the invention, therefore, the low-pressure flows 30, 40, 50 are not distributed over the entire width of the heat exchanger core 9. The heat exchanger core 9 is subdivided in its width by separating sheets 70 (see FIGS. 5, 6, and 14), so-called side bars, into three areas 33, 43, 53. On the top and bottom end of the heat exchanger core 9, the collectors/distributors 31, 41, 51 and 32, 42, 52 are connected to each of these areas 33, 43, 53, respectively. The collectors/distributors 31, 41, 51 and 32, 42, 52 are made semi-cylindrical and have a connecting branch for the respective product supply or discharge. The low-pressure flows 30, 40, 50 that have been fed into the heat exchanger core 9 do not undergo any cross-sectional change or significant change in the flow direction. Thus, the pressure drop experienced by these low-pressure flows over the heat exchanger core 9 is reduced by roughly 30%, in comparison to the pressure drop over a conventional core, as shown in FIGS. 2 to 4. Furthermore, the costs for the heat exchanger core 9 are reduced since the complex cutting-out of inclined plates for the distribution/collection zones 39, 49, 59 in FIGS. 2 to 4 can be abandoned.

Instead of the complex distribution zones 39, 49, 59 with inclined plates, as in known heat exchanger cores (see FIGS. 2 to 4), in the new heat exchanger cores there is preferably only one narrow distribution zone 73 on the inlet and outlet area of the heat exchange passages 33, 43, 53. The narrow distribution zones 73 are preferably located immediately below the inlet into the heat exchange passages and immediately above the outlet of the heat exchange passages. To avoid high pressure drops, the distribution is preferably rather limited. The plates in the narrow distribution zone 73 are positioned parallel to the heat exchange passages 33, 43, 53, but have a shorter distance from one another. The gas that enters the collector 31, 41, 51 dams up slightly in front of the distribution zone 73, by which a uniform distribution of the gas among all passages of the distribution zone 73 and thus among all heat exchange passages 33, 43, 53 is achieved.

In the prior art, the distributors and collectors located on the top and bottom of the core were welded to the separating plate separating the heat exchange passages for a first fluid from the heat exchange passages for a second fluid. However, since the separating plates are made of relatively thin metal while the distributors/collectors are made of relatively thick metal, it is difficult to achieve a fluid tight connection.

In accordance with the invention, distributors/collectors for the low pressure fluids extend in a direction which is perpendicular to the separating plates and the distributors/collectors are welded to the side bars which are made or relatively thick metal. Thus, welding of the distributors/collectors to the heat exchange core does not impose a problem.

Figure 6:
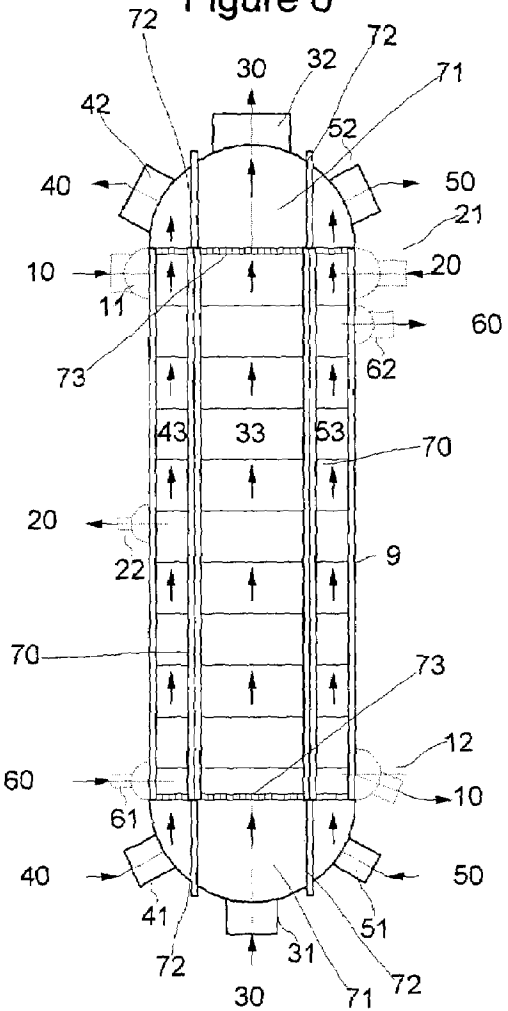
FIG. 6 shows a variant of the embodiment according to FIG. 5.

FIG. 6 shows a variant of the heat exchanger according to the invention. The heat exchanger core 9 is similar to the heat exchanger core that is shown in FIG. 5. However, in the embodiment of FIG. 6 there are no individual collectors/distributors 31, 41, 51 or 32, 42, 52, but rather a common collector/distributor 71 (one at the top and one at the bottom) that traverses the entire fore part of the heat exchanger core 9. The space between the fore part of the heat exchanger core 9 and the collector/distributor 71 is subdivided according to the areas 33, 43, 53 by side bars 72 and each subdivision is provided with a connecting branch (31, 41, 51 and 32, 42, 52).

Figure 8:
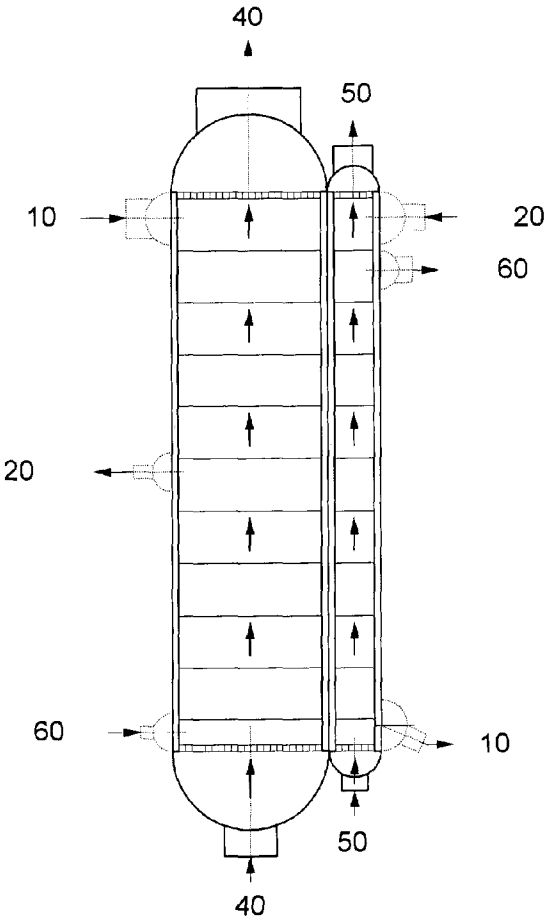
FIGS. 7 and 8 show the division of a heat exchanger according to the invention into two component areas.
Figure 7:
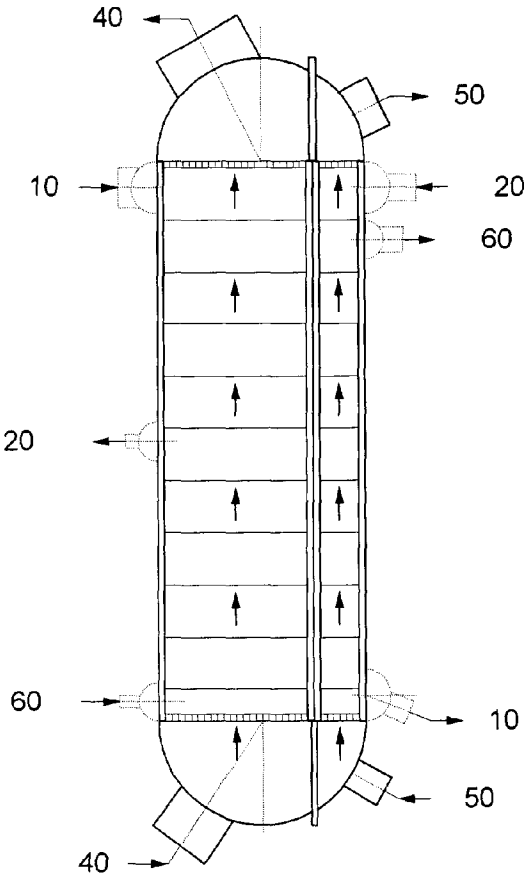

FIGS. 7 and 8 show other embodiments of the invention. These heat exchangers are used, for example, in air-separation processes in which the uppermost section of the low-pressure column is abandoned so that low-pressure nitrogen 36 is no longer produced in the low-pressure column. The number of low-pressure flows is thus reduced to the impure nitrogen flow 40 and oxygen flow 50. Thus, the main heat exchanger core 9 can be made simpler. The heat exchange passages for the low-pressure flows 40, 50, as is shown in FIGS. 7 and 8, are made according to the invention, and the pressure flows 10, 20, 60 are distributed and collected in the conventional manner over distribution/collection zones communicating with the corresponding heat exchange passages.

The invention can be used advantageously in all air-separation processes in which there are at least two low-pressure flows, thus, for example, in air-separation processes with an air cycle or with a nitrogen cycle.

Figure 9:
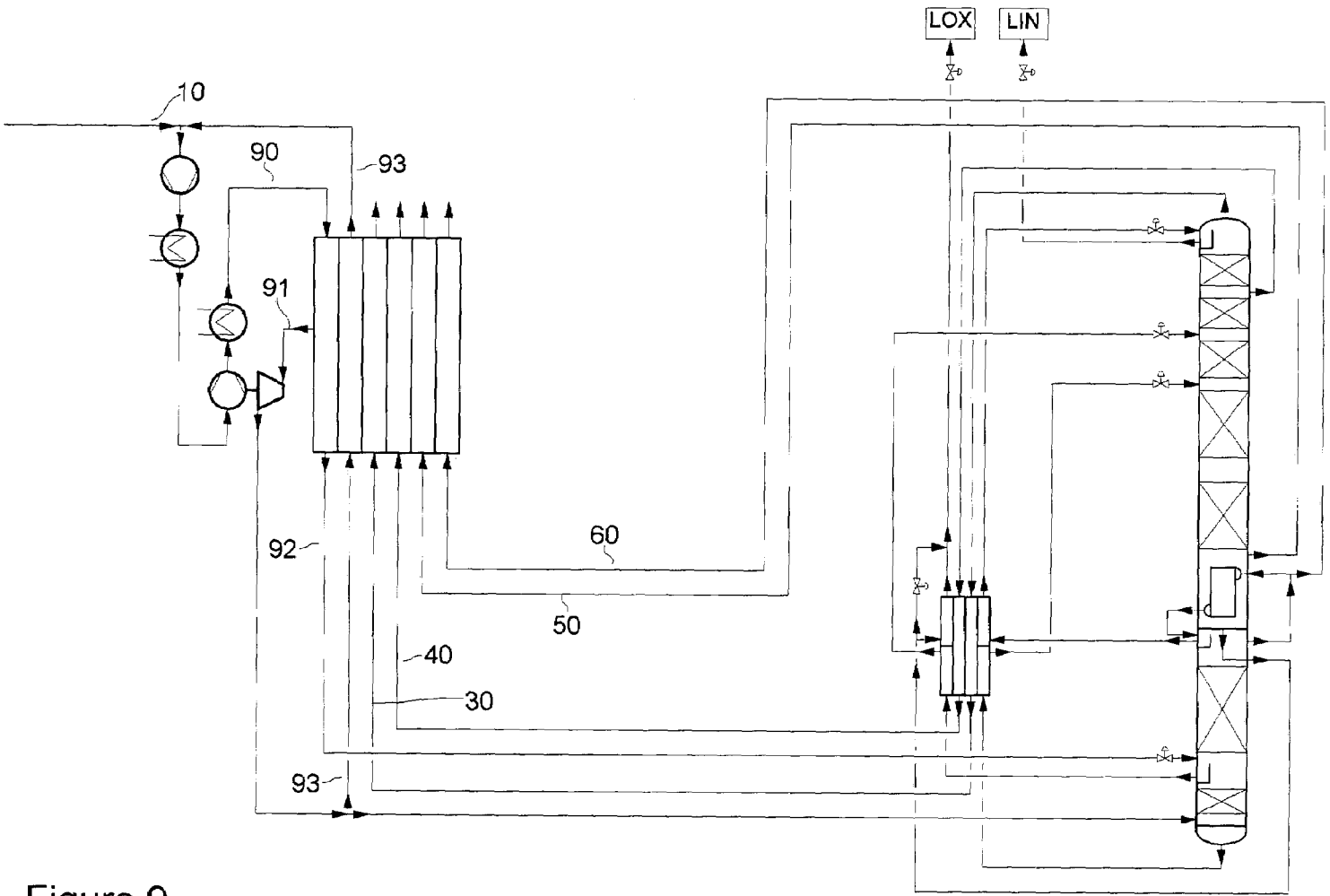
FIG. 9 is a process diagram of an air-separation system with a single-turbine air cycle.

FIG. 9 shows, for example, a low-temperature air-separation process with a single-turbine air cycle. The feed air 10 is compressed here and is introduced as a high-pressure air flow 90 into the main heat exchanger. One part 91 of the high-pressure air is withdrawn at an intermediate point from the heat exchanger, expanded and in part supplied to the high-pressure column. Another part 93 of the high-pressure air 90 is returned to the heat exchanger 90 and combined again with the feed air 10. The remainder of the high-pressure air 90 is routed as a high-pressure flow 92 directly into the pressure column.

Figure 11:
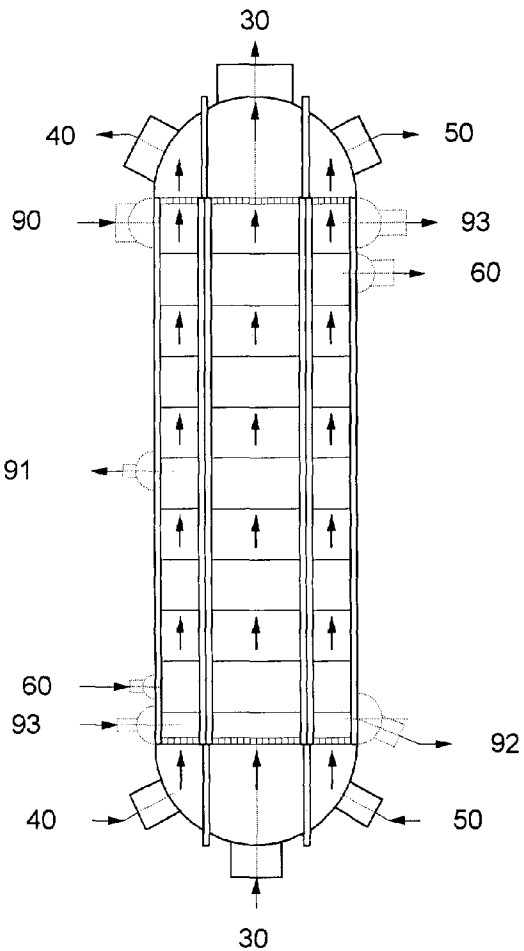
FIG. 11 shows the arrangement of the heat exchange passages of the main heat exchanger according to the invention in the process according to FIG. 9.

FIG. 11 illustrates an embodiment shows the execution of the heat exchanger core 9 according to the invention for one such process. The low-pressure flows 30, 40, 50 are in turn routed through the corresponding component areas of the core 9 according to the invention, and the pressurized flows 60, 90, 93 are distributed/collected in the conventional manner via the distribution/collection zones among the heat exchange passages.

Figure 10:
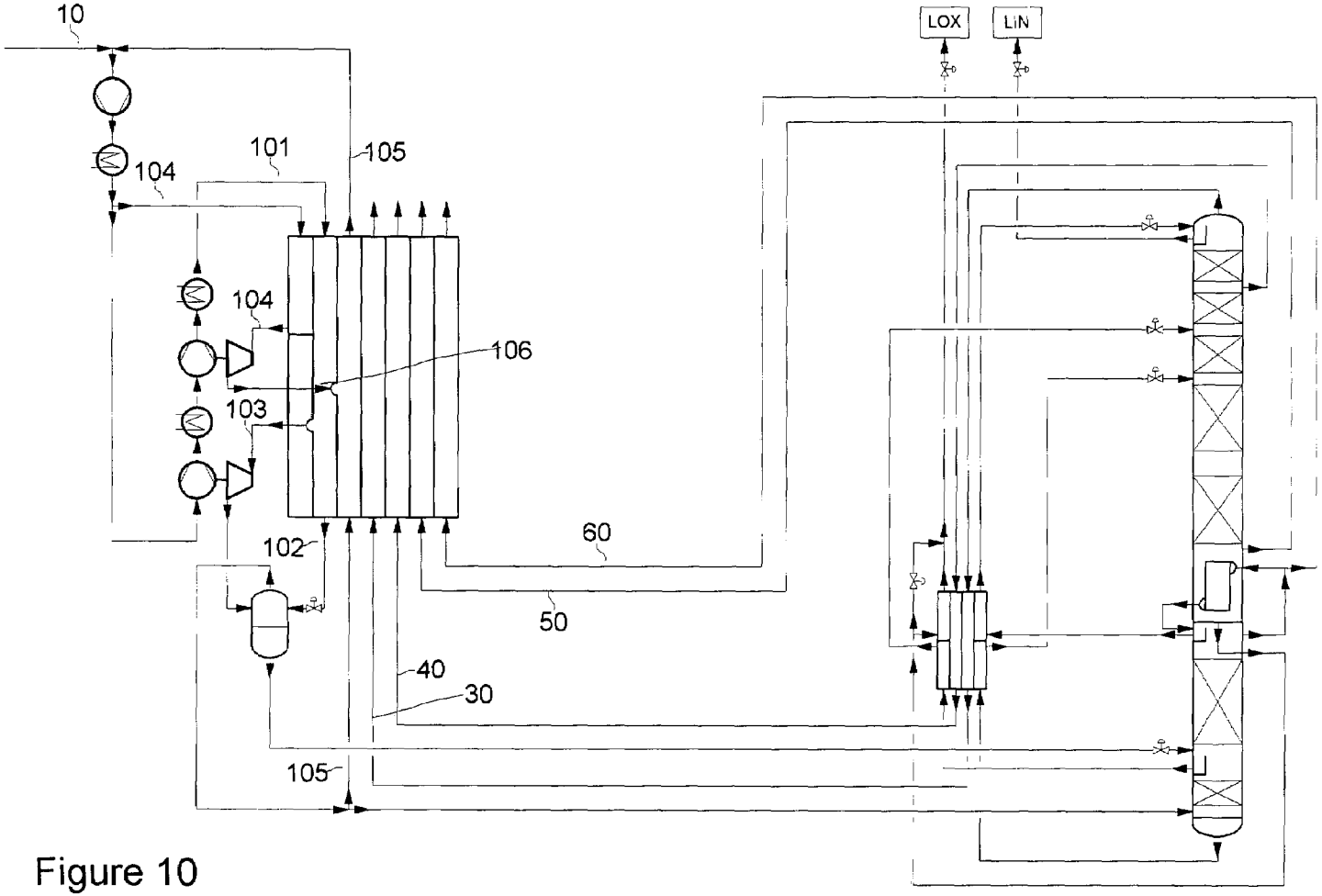
FIG. 10 shows a process diagram of an air-separation system with a dual-turbine air cycle.
Figure 12:
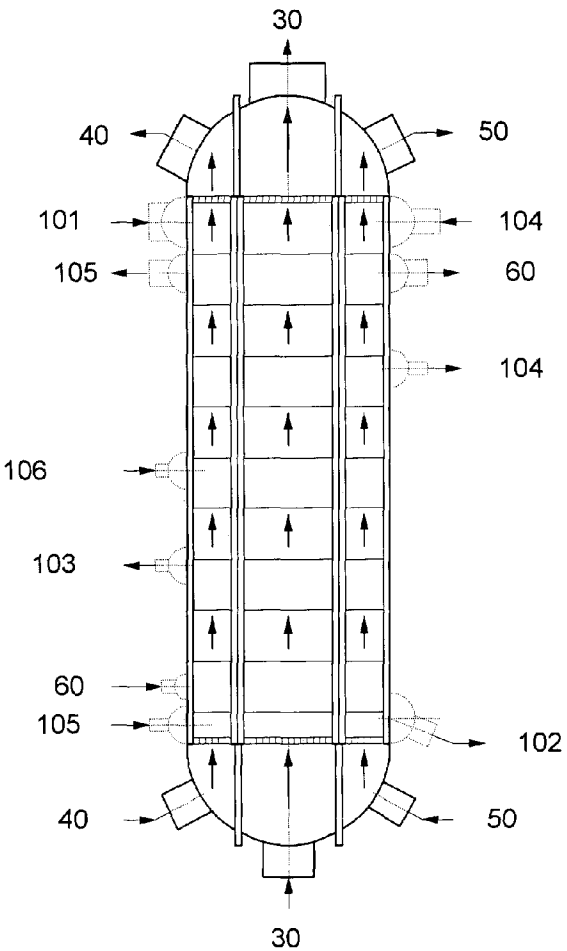
FIG. 12 shows the arrangement of the heat exchange passages of the main heat exchanger according to the invention in the process as shown in FIG. 10.

FIG. 10 shows an air-separation process with a dual-turbine air cycle, and FIG. 12 shows the corresponding configuration of the main heat exchanger 9. The heat exchange passages for the low-pressure flows 30, 40, 50 run analogously to the embodiment shown in FIG. 11. The flows 101, 104, 105, 106 that are under higher pressure are routed through the heat exchanger, as shown in FIG. 12.

Figure 13:
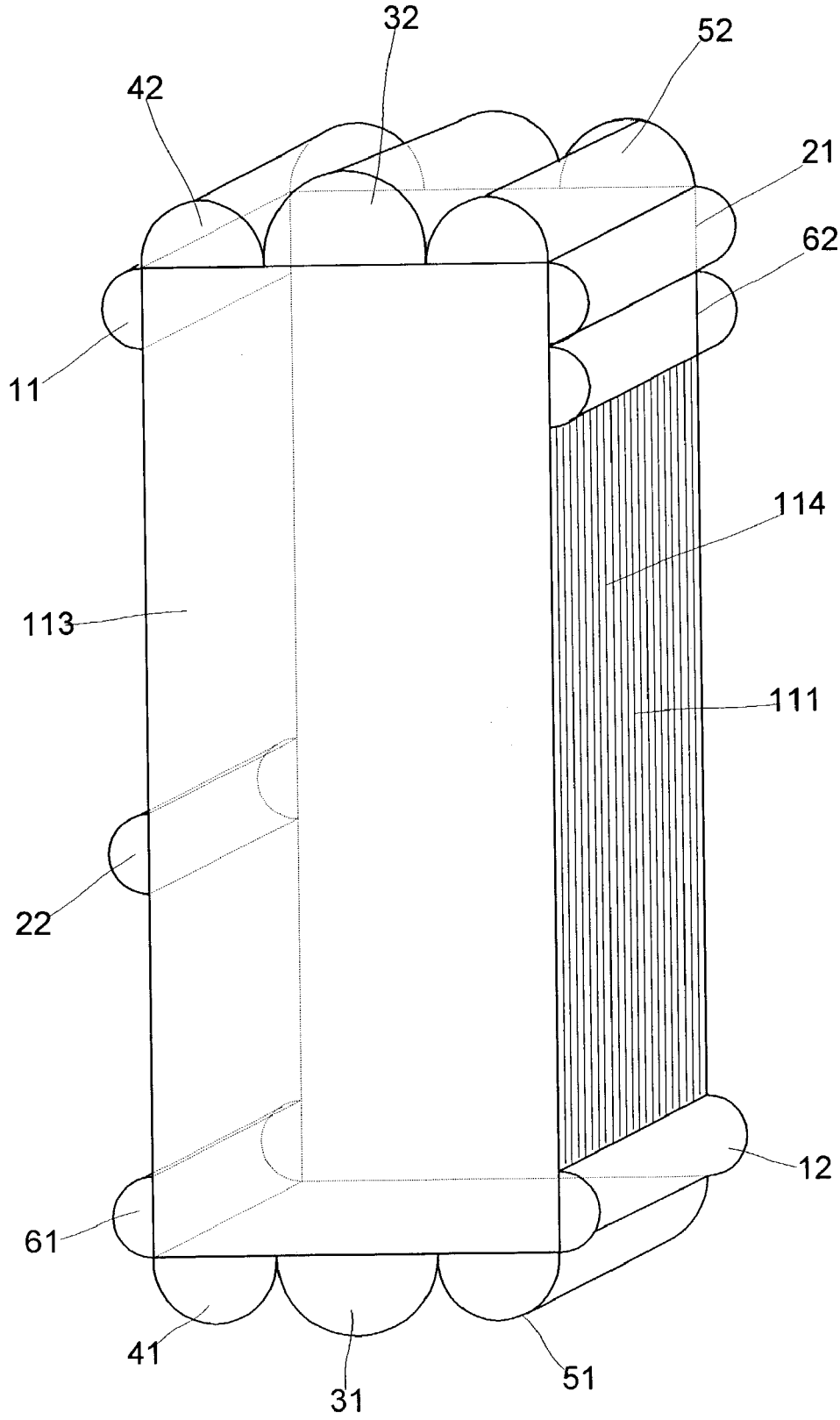
FIG. 13 is an isometric view of the heat exchanger illustrated in FIG. 5.
Figure 14:
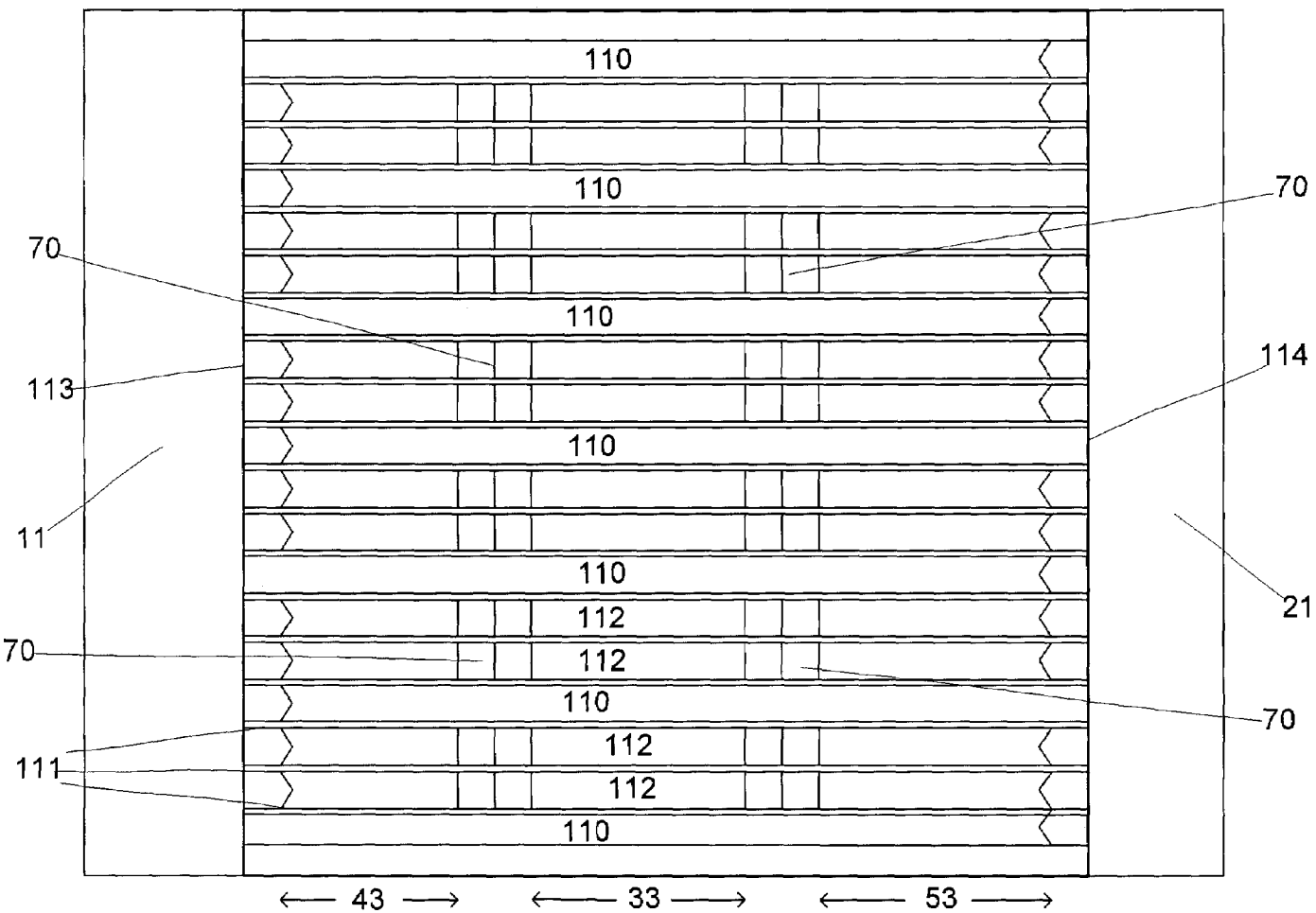
FIG. 14 is a cross-sectional view of a heat exchanger according to the invention.

FIG. 13 illustrates an isometric view of the heat exchanger of FIG. 5. As shown on the right side of FIG. 13, the heat exchanger core comprises a plurality of parallel separating plates 111. As shown in FIG. 14, spaces between adjacent plates (110 and 112) define passageways for fluid flow and heat transfer. As discussed previously, these passageways 110 and 112 can be divided into groups of heat exchange passages by fins positioned between the separating plates 111. Fluid flows 10, 20, 30, 40, 50, and 60 enter the heat exchanger via distributors 11, 21, 31, 41, and 51, respectively. The fluids 10, 20, 30, 40, 50, and 60 flow through the heat exchanger core 9 via the passageways defined between plates 111 and then are removed from the heat exchanger via collectors 12, 22, 32, 42, 52, and 62, respectively.

FIG. 14 provides a cross-sectional view of the heat exchanger core which shows the passageways 110 and 112. Feed air 10 flows through some of the passageways 110, while high-pressure air flow through other passageways 110. As can be seen, passageways 110 extend the entire width of the heat exchanger. Conversely, the spaces that form passageways 112 are subdivided by side bars 70 into three groups or three areas of passageways 112 along the width of the heat exchanger, i.e. areas 33, 43, 53. Thus, the gaseous product nitrogen 30 flows through the passageways 112 in component area 33; low-pressure impure nitrogen 40 flows through the passageways 112 in component area 43; and gaseous oxygen 50 flows through the passageways 112 in component area 53.

Since the heat exchange passageway 100 for the feed air 10 and high-pressure air 12 extend over the entire width of the core, within a given passageway 110 there will be a certain amount of heat exchange between air flowing through the left side 113 of the passageway 110 and air flowing through the right side 114 of the passageway. If, for example, the flow 50 of gaseous oxygen is reduced, the temperature of the air 10, 20 flowing through the right side 114 will increase. However, this temperature increased would be balanced by heat transfer within passageway 110 from the left side 113 to the right side 114.

Figure 15:
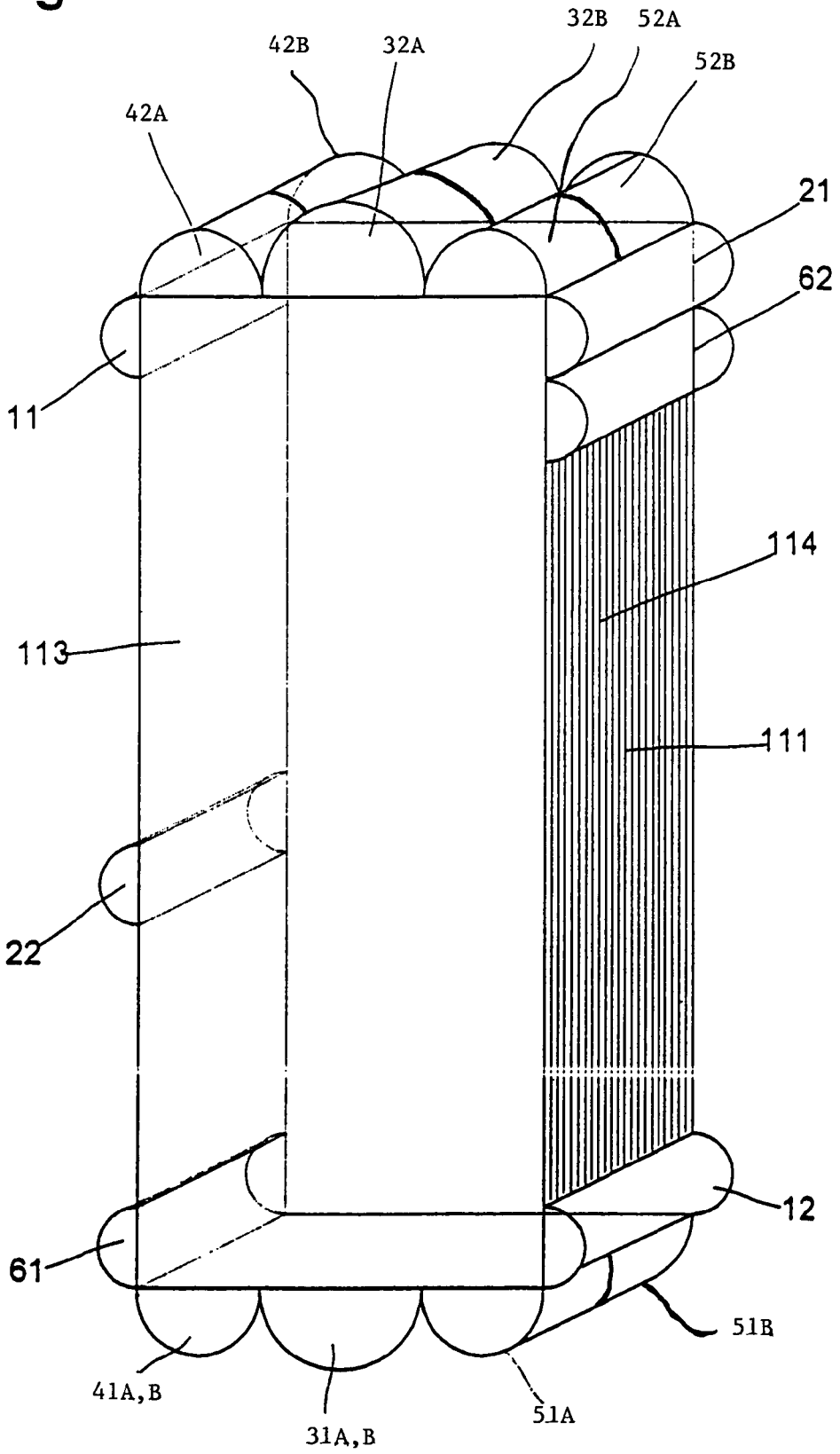
FIG. 15 illustrates an isometric view, similar to FIG. 13, wherein each of the component areas extends over only part of the width of the heat exchanger core and over only part of the depth of the heat exchanger core.

FIG. 15 illustrates an isometric view of a heat exchanger similar to that of FIG. 5. but in which the heat exchanger is divided along its depth as well as its width so that flows 30, 40 and 50 can each be two separate flows. Thus, fluid flows enter the heat exchanger via distributors 11, 21, 31A, 31B, 41A, 41B, 51A, 51B, and 61. The fluids flow through the heat exchanger core 9 via the passageways defined between plates 111 (see FIG. 14) and then are removed from the heat exchanger via collectors 12, 22, 32A, 32B, 42A, 42B, 52A, 52B, and 62, respectively.

The entire disclosure of all applications, patents and publications, cited above and below, and of corresponding German Application No. 10201832.4, filed Jan. 18, 2002, and parent application Ser. No. 10/347,486, filed Jan. 21, 2003, are hereby incorporated by reference.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

The invention claimed is:

1. A plate heat exchanger for indirect heat exchange between at least one heat transfer medium/cooling medium and a plurality of fluid flows comprising:

a heat exchanger core having a plurality of heat exchange passages for flow of at least one heat transfer medium/cooling medium, flow of a first fluid, and flow of a second fluid, wherein the heat exchange passages for the flows of said at least one heat transfer medium/cooling medium, said first fluid, and said second fluid run parallel to one another, said heat exchanger core (9) having a first component area and a second component area, said first component area containing heat exchange passages for the first fluid flow (40), and said second component area containing heat exchange passages for the second fluid flow (30), wherein said first and the second component areas are not in fluid communication, and said first and second component areas each extend over the height of the heat exchanger core (9) and said passages of said first and the second component areas are rectilinear over the height of said heat exchanger core, the height of the heat exchanger core (9) being its extension in the direction of the main flow through the heat exchange passages, and each of said first and second component areas extends over only part of the width of the heat exchanger core.

2. A plate heat exchanger according to claim 1, wherein the heat exchanger core (9) has a plurality of separating plates arranged parallel to one another, wherein the spaces between adjacent pairs of plates contain said heat exchange passages for the heat transfer medium/cooling medium (10, 20), the first fluid flow (30, 40, 50), and the second fluid flow (30, 40, 50), and wherein said first and the second component areas each extend over the depth of the heat exchanger core (9), the depth of the heat exchanger core (9) being its extension in the direction perpendicular to the plane of said separating plates.

3. A plate heat exchanger according to claim 1, wherein the heat exchanger core has a plurality of separating plates arranged parallel to one another, wherein the spaces between adjacent pairs of plates contain said heat exchange passages for the flow of transfer medium/cooling medium, the first fluid flow, and the second fluid flow, and wherein said heat exchange passages for the flow of heat transfer medium/cooling medium extend over the entire width of the heat exchanger core, the width of the heat exchanger core being its extension in the plane of the separating plates and in the direction perpendicular to the direction of flow through the heat exchange passages.

4. A plate heat exchanger according to claim 2, wherein said heat exchange passages for the flow of heat transfer medium/cooling medium extend over the entire width of the heat exchanger core, the width of the heat exchanger core being its extension in the plane of the separating plates and in the direction perpendicular to the direction of flow through the heat exchange passages.

5. A plate heat exchanger according to claim 1, wherein the heat exchange passages for the heat transfer medium/cooling medium (10, 20) are distributed uniformly over the entire width of the heat exchanger core (9).

6. A plate heat exchanger according to claim 1, wherein said heat exchange core has a third component area which is not in fluid communication with said first and second component areas and which extends over the entire height of said heat exchanger core, said third component area containing heat exchange passages for flow of a third fluid flow and said passages of said third component areas are rectilinear over the height of said heat exchanger core, and said third component area extends over only part of the width of the heat exchanger core.

7. A plate heat exchanger according to claim 6, wherein the heat exchanger core (9) has a plurality of separating plates arranged parallel to one another, wherein the spaces between adjacent pairs of plates contain said heat exchange passages for the heat transfer medium/cooling medium (10, 20), the first fluid flow (30, 40, 50), and the second fluid flow (30, 40, 50), and wherein said first and the second component areas each extend over the depth of the heat exchanger core (9), the depth of the heat exchanger core (9) being its extension in the direction perpendicular to the plane of said separating plates.

8. A plate heat exchanger according to claim 7, wherein the heat exchanger core has a plurality of separating plates arranged parallel to one another, wherein the spaces between adjacent pairs of plates contain said heat exchange passages for the flow of transfer medium/cooling medium, the first fluid flow, and the second fluid flow, and wherein said heat exchange passages for the flow of heat transfer medium/cooling medium extend over the entire width of the heat exchanger core, the width of the heat exchanger core being its extension in the plane of the separating plates and in the direction perpendicular to the direction of flow through the heat exchange passages.

9. A heat exchanger according to claim 2 wherein said first component area communicates with a single distributor which traverses the depth of the heat exchanger core and a single collector that traverses the depth of the heat exchanger core.

10. In a process for cryogenic air-separation comprising separating air into an oxygen product stream and a nitrogen product stream in air rectification system having a heat exchanger for cooling feed air, the improvement wherein said heat exchanger is a plate heat exchanger according to claim 1.

11. A process for indirect heat exchange of several fluid flows with a heat transfer medium/cooling medium in a heat exchanger core, comprising:

routing the heat transfer medium/cooling medium, a first fluid flow and a second fluid flow through a plurality of parallel heat exchange passages whereby said heat transfer medium/cooling medium, said first fluid, and said second fluid run flow parallel to one another, wherein the first fluid flow (50) is routed through a first component area of the heat exchanger core (9) and the second fluid flow is routed through a second component area of the heat exchanger core (9), the first and the second component areas are not in fluid communication, and the first and the second component areas each extend over the entire height of the heat exchanger core and flow through said passages of the first and second component areas is rectilinear over the height of said heat exchanger core (9), the height of the heat exchanger core (9) being its extension in the direction of the main flow through the heat exchange passages, and each of the first and second component areas extends over only part of the width of the heat exchanger core.

12. A process according to claim 11, wherein the first and the second fluid flows (30, 40, 50) each have a pressure of less than 3.5 bar.

13. A process according to claim 11, wherein the first and the second fluid flows (30, 40, 50) each have a pressure of 1.1–1.8 bar.

14. A process according to claim 11, wherein another fluid flow with a pressure of more than 4 bar is routed through the heat exchanger core.

15. A process according to claim 11, wherein the first and second fluid flows are obtained by cryogenic separation of feed air.

16. A process according to claim 15, wherein the first and second fluid flows are brought into indirect heat exchange with air.

17. A plate heat exchanger for indirect heat exchange between at least one heat transfer medium/cooling medium and a plurality fluid flows comprising:

a heat exchanger core having a plurality of heat exchange passages for flow of at least one heat transfer medium/cooling medium, flow of a first fluid, and flow of a second fluid, said heat exchanger core (9) having a first component area and a second component area, said first component area containing heat exchange passages for the first fluid flow (40), a said second component area containing heat exchange passages for the second fluid flow (30), wherein said first and the second component areas are not in fluid communication, and said first and second component areas each extend over the height of the heat exchanger core (9) and said passages of said first and the second component areas are rectilinear over the height of said heat exchanger core, the height of the heat exchanger core (9) being its extension in the direction of the main flow through the heat exchange passages, and each of said first and second component areas extends over only part of the width of the heat exchanger core, and wherein, in addition to said first component area and a second component area, said heat exchanger core (9) comprises a third component area and a fourth component area, and each of said component areas extends over only part of the width of the heat exchanger core and over only part of the depth of the heat exchanger core.

18. A plate heat exchanger according to claim 1, wherein said heat exchange core further comprises one or more additional component areas, each being connected to a distribution zone (11, 21, 61) having inclined plates and a collection zone having inclined plates (12, 22, 62), each of said additional component areas extending over the entire width of the heat exchanger core, and each of said additional component areas having vertically running heat exchange passages for the flow of fluids (10, 20, 60).

19. A plate heat exchanger according to claim 1, wherein said heat exchanger core (9) is subdivided along its width by separating sheets (70) to form said first and second component areas.

20. A plate heat exchanger according to claim 6, wherein said heat exchanger core (9) is subdivided along its width by separating sheets (70) to form said first, second, and third component areas (33, 43, 53).

21. A plate heat exchanger for indirect heat exchange between at least one heat transfer medium/cooling medium and a plurality of fluid flows comprising:

a heat exchanger core having a plurality of heat exchange passages for flow of at least one heat transfer medium/cooling medium, flow of a first fluid, and flow of a second fluid, said heat exchanger core (9) having a first component area and a second component area, said first component area containing heat exchange passages for the first fluid flow (40), and said second component area containing heat exchange passages for the second fluid flow (30), wherein said first and the second component areas are not in fluid communication, and said first and second component areas each extend over the height of the heat exchanger core (9) and said passages of said first and the second component areas are rectilinear over the height of said heat exchanger core, the height of the heat exchanger core (9) being its extension in the direction of the main flow through the heat exchange passages, and each of said first and second component areas extends over only part of the width of the heat exchanger core, and wherein said heat exchange core further comprises one or more additional component areas, each being connected to a distribution zone (11, 21, 61) having inclined plates and a collection zone having inclined plates (12, 22, 62), each of said additional component areas extending over the entire width of the heat exchanger core, and each of said additional component areas having vertically running heat exchange passages for the flow of fluids (10, 20, 60).

22. A plate heat exchanger for indirect heat exchange between at leat one heat transfer medium/cooling medium and a plurality of fluid flows comprising:

a heat exchanger core having a plurality of heat exchange passages for flow of at least one heat transfer medium/cooling medium, flow of a first fluid, and flow of a second fluid, wherein the heat exchange passages for the flows of said at least one heat transfer medium/cooling medium, said first fluid, and said second fluid run parallel to one another;

said heat exchanger core (9) having a first component area and a second component area, said first component area containing heat exchange passages for the first fluid flow (40), and said seconc component area containing heat exchange passages for the second fluid flow (30), wherein said first and the second component area not in fluid communication, and said first and second component areas each extend over the height of the heat exchanger core (9) and said passages of said first and the second component areas are rectilinear over the height of said heat exchanger core, the height of the heat exchanger core (9) being its extension in the direction of the main flow through the heat exchnge passages, and each of said first and second component areas extends over only part of the width of the heat exchanger core, and wherein the heat exchanger core (9) has a plurality of separating plates arranged parralel to one another, wherein the spaces between adjacent pairs of plates contain said heat exchange passages for the heat transfer medium/cooling medium (10, 20), the first fluid flow (30, 40, 50), and the second fluid flow (30, 40, 50), and wherein said first and the second component areas each extend over the depth of the heat exchange core (9), the depth of the heat exchange core (9) being its extension in the direction perpendicular to the plane of said separating plates.

* * * * *

UNITED STATES PATENT AND TRADEMARK OFFICE

CERTIFICATE OF CORRECTION

PATENT NO. : 7,188,492 B2
APPLICATION NO. : 10/612287
DATED : March 13, 2007
INVENTOR(S) : Horst Corduan It is certified that error appears in the above-identified patent and that said Letters Patent is hereby corrected as shown below:

Column 14, line 4 reads “seconc” Should read -- second --

Column 14, line 19 reads “parralel” Should read -- parallel --

Signed and Sealed this

Fifth Day of August, 2008

JON W. DUDAS
*Director of the United States Patent and Trademark Office*